US007975903B2

(12) United States Patent
Haas

(10) Patent No.: US 7,975,903 B2
(45) Date of Patent: Jul. 12, 2011

(54) ENVELOPE THAT PROTECTS PRIVACY OF PRIMARY CONTENT WHEN INSERTING SECONDARY MATERIAL

(75) Inventor: Bertrand Haas, New Haven, CT (US)

(73) Assignee: Pitney Bowes Inc., Stamford, CT (US)

( * ) Notice: Subject to any disclaimer, the term of this patent is extended or adjusted under 35 U.S.C. 154(b) by 959 days.

(21) Appl. No.: 11/853,989

(22) Filed: Sep. 12, 2007

(65) Prior Publication Data

US 2009/0065564 A1 Mar. 12, 2009

(51) Int. Cl.
*B65D 27/08* (2006.01)

(52) U.S. Cl. ..... 229/72

(58) Field of Classification Search ..... 229/72
See application file for complete search history.

(56) References Cited

U.S. PATENT DOCUMENTS

| | | | | |
|---|---|---|---|---|
| 544,276 | A * | 8/1895 | Albert | 229/72 |
| 738,891 | A * | 9/1903 | Eckart | 229/92.3 |
| 1,334,138 | A * | 3/1920 | Dorgan et al. | 229/72 |
| 1,516,925 | A * | 11/1924 | Lewis et al. | 229/72 |
| 1,706,300 | A * | 3/1929 | Kakaley | 229/72 |
| 1,772,280 | A * | 8/1930 | Fraser | 229/72 |
| 2,236,659 | A | 4/1941 | White | |
| 3,266,712 | A | 8/1966 | McCleneghan | |
| 3,522,908 | A | 8/1970 | Carrigan | |
| 4,129,214 | A | 12/1978 | Gendron | |
| 5,713,511 | A | 2/1998 | Diamond | |
| 5,806,754 | A | 9/1998 | Boyle | |

FOREIGN PATENT DOCUMENTS

| | | |
|---|---|---|
| DE | 4114373 A1 | 11/1991 |
| DE | 9103682 | 9/1992 |
| GB | 1337662 | 11/1973 |

* cited by examiner

*Primary Examiner* — Jes F Pascua
(74) *Attorney, Agent, or Firm* — Brian A. Lemm; Charles R. Malandra, Jr.

(57) ABSTRACT

An envelope that allows a mailer to partly seal an envelop such that the primary content is sealed within the envelope while still allowing a third party to insert secondary material into the envelope is provided. An envelope includes a first sheet and a second sheet that forms a first pouch between the second sheet and the first sheet. The first pouch has a top opening and a side opening. The envelope also includes a third sheet that forms a second pouch between the third sheet and the second sheet. The second pouch has a top opening. The envelope also has a first flap for closing both the top opening of the first pouch and the top opening of the second pouch. The envelope also includes a second flap for closing the side opening of the first pouch.

9 Claims, 10 Drawing Sheets

ENVELOPE THAT PROTECTS PRIVACY OF PRIMARY CONTENT WHEN INSERTING SECONDARY MATERIAL

BACKGROUND

The present invention relates to a mailing envelope that allows secondary content to be inserted into the envelope without having access to primary content already inserted into the envelope.

Reducing the costs for postage is typically a priority for companies or other entities that send large amounts of mail. One such way to reduce costs is to charge a fee in exchange for allowing third parties to insert promotional or advertising materials, referred to as secondary material, into the mail pieces. To perform this, the original mailer can provide each mail piece, already containing the primary contents, to the third party for insertion of the secondary material. This requires, however, that each envelope be unsealed when provided to the third party. This presents several concerns for the primary content of a mail piece. For example, with the envelope unsealed, the primary content could be inadvertently removed or fall out of the mail piece and be lost. If the primary content contains confidential or private information, there is no way for the original mailer to ensure that the privacy or confidentiality of the primary content is not compromised.

SUMMARY

The present invention provides an envelope that allows a mailer to partly seal an envelop such that the primary content is sealed within the envelope while still allowing a third party to insert secondary material into the envelope. According to an aspect of the invention, an envelope includes a first sheet and a second sheet that forms a first pouch between the second sheet and the first sheet. The first pouch has a top opening and a side opening. The envelope also includes a third sheet that forms a second pouch between the third sheet and the second sheet. The second pouch has a top opening. The envelope also has a first flap for closing both the top opening of the first pouch and the top opening of the second pouch. The envelope also includes a second flap for closing the side opening of the first pouch.

A main or primary letter, addressed to the recipient, such as, for example, a bill or account statement, may be inserted initially into the second pouch via the second pouch's top opening. The first flap is then sealed, to close the top openings of both pouches, therefore effectively sealing the second pouch with the primary letter inside.

The resulting mail piece may then be transferred (in bulk, with like mail pieces) to another facility. At the other facility, advertising material is inserted into the first pouch via its side opening. The side opening is then sealed with the second flap and the mail piece is mailed to the recipient.

The recipient opens the first flap to access the primary letter, thereby also opening the first pouch and obtaining access to the advertising material.

In this way, business correspondence and advertising material may be combined in a single mail piece, while protecting the privacy of the business correspondence from the entity that adds the advertising material to the mail piece. A combined mail piece of this type may reduce the cost of promotional mailings while also enhancing its effectiveness by increasing the likelihood that the recipient will read the advertising material.

According to other aspects of the invention, a method is provided. The method includes receiving a mail piece comprising a letter pouch that includes a letter addressed to a recipient. The mail piece also has an empty advertising material pouch with a side opening. The method further includes inserting advertising material into the advertising material pouch via the side opening, sealing the side opening, and mailing the mail piece to the recipient.

In this method, the advertising material may not be addressed to the recipient. The method may further include determining the weight of the mail piece prior to the inserting step, and selecting the advertising material based at least in part on the weight of the mail piece prior to the inserting step.

According to still other aspects of the invention, a method includes providing a generally L-shaped sheet of paper. The sheet of paper includes a base sheet section, a right-hand sheet section joined to the base sheet section at a right side of the base sheet section, and a top section joined to the base sheet section at a top side of the base sheet section. The base sheet section has a left edge and a bottom edge. The right-hand sheet section has a top edge, a right edge and a bottom edge. The top sheet section has a first flap at a left side of the top sheet section, a second flap at a top side of the top sheet section, and a third flap at a right side of the top sheet section. The method further includes folding the sheet of paper at the right side of the base sheet section to bring the right edge of the right-hand sheet section into proximity with the left edge of the base sheet section. The method also includes folding the sheet at the top side of the base sheet section to bring the left edge of the base sheet section over the left side of the top sheet section. In addition, the method includes adhering the first flap to the left side of the base sheet section, such that a first pouch is formed between the right-hand sheet section and the top sheet section and a second pouch is formed between the right-hand sheet section and the base sheet section.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, descriptions, and claims.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The several embodiments described herein are provided solely for the purpose of illustration. Embodiments may include any currently or hereafter-known versions of the elements described herein. Therefore, persons in the art will recognize from this description that other embodiments may be practiced with various modifications and alterations.

Figure 1:
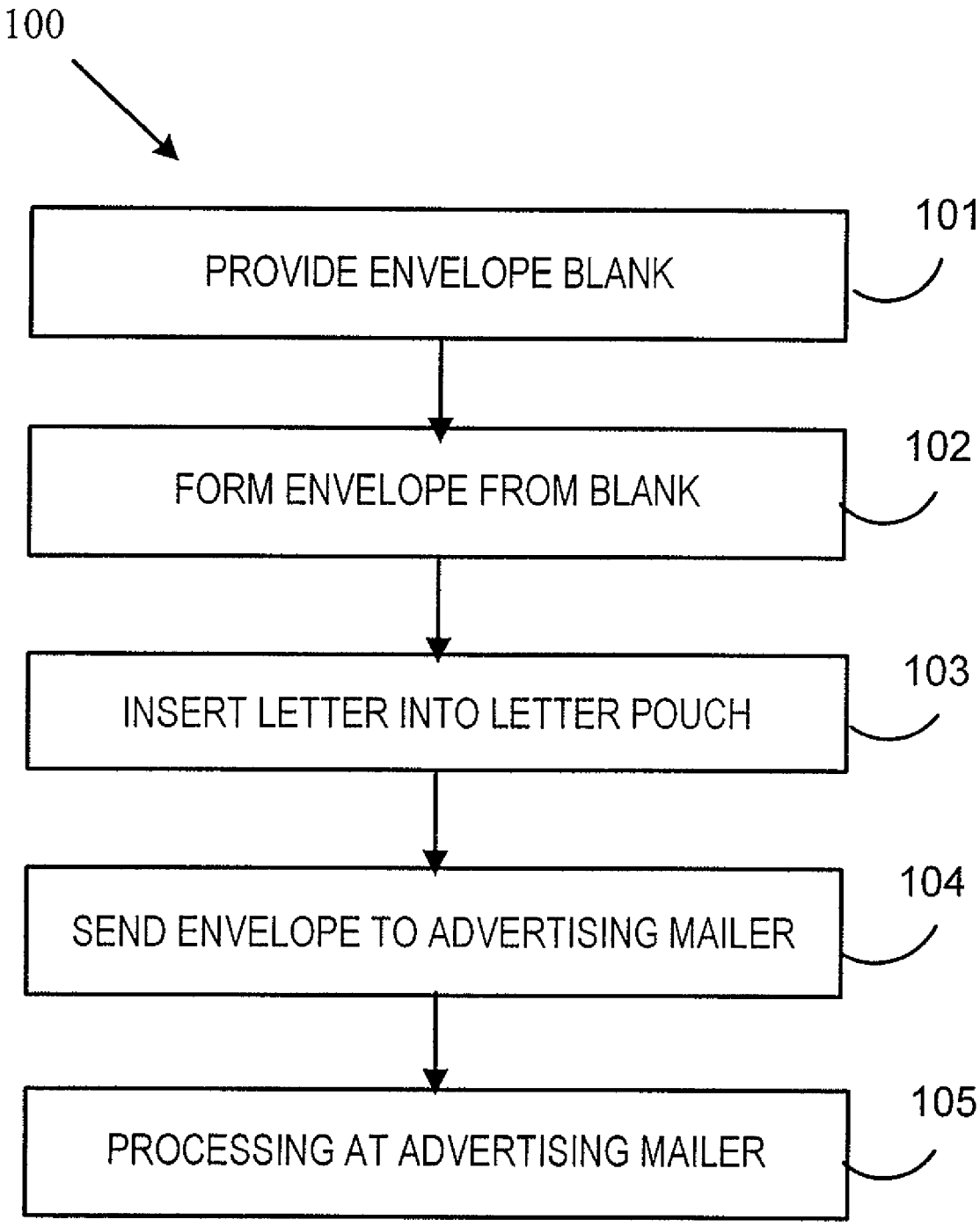
FIG. 1 is a flow chart that illustrates a method according to some embodiments.
Figure 2:
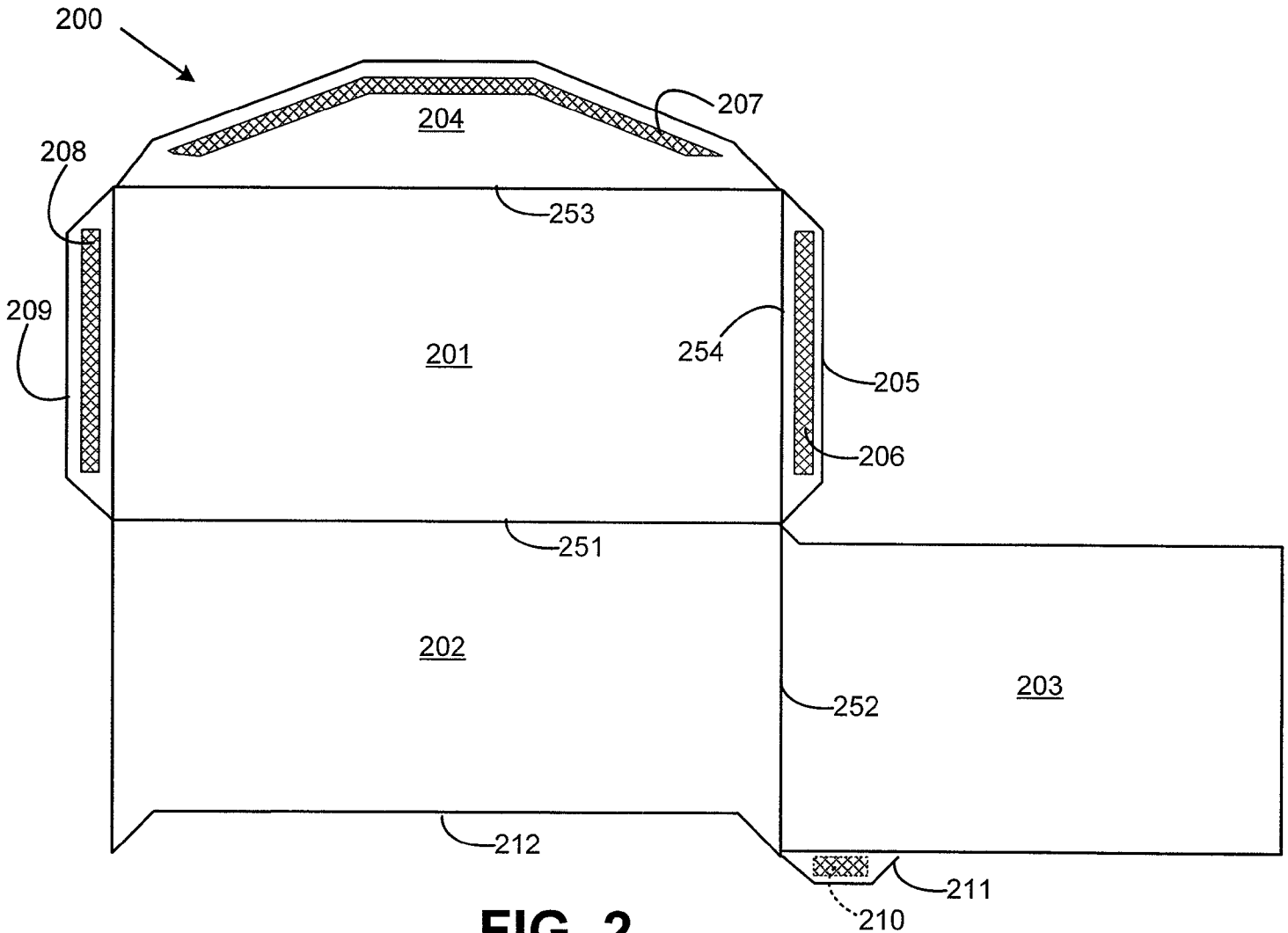
FIG. 2 illustrates an envelope blank according to some embodiments.

Now referring to FIG. 1, an embodiment of a method 100 is illustrated. At 101, an envelope blank is provided. In one embodiment, an envelope blank may comprise a disassembled envelope or an unfolded envelope such as envelope blank 200 of FIG. 2. The envelope blank 200 may comprise a generally L-shaped sheet of paper and may be cut from a single sheet of paper. In some embodiments, after an envelope blank 200 is cut, one or more types of adhesive may then be applied to the envelope blank 200. In some embodiments, one or more types of adhesive may be applied prior to the envelope blank 200 being cut.

The envelope blank 200 includes a base sheet section 202, a right-hand sheet section 203 joined to the base sheet section 202 at a right side of the base sheet section 202, and a top sheet section 201 joined to the base sheet section 202 at a top side of the base sheet section 202. The base sheet section 202, the right-hand sheet section 203, and the top sheet section 201 may be comprised of paper, cardboard, or any material suitable for mailing. The base sheet section 202 includes a left edge and a bottom edge. The right-hand sheet section 203 includes a top edge, a right edge and a bottom edge. The top sheet section 201 may comprise a first flap 209 at a left side of the top sheet section 201, a second flap 204 at a top side of the top sheet section 201, and a third flap 205 at a right side of the top sheet section 201.

The base sheet section 202 may be coupled to a bottom side of the top sheet section 201 at a fold line 251. In some embodiments, and as illustrated, the base sheet section 202 may comprise a cutout 212 to facilitate the placement of material inside a constructed envelope. However, in some embodiments, the base sheet section 203 may not comprise the cutout 212. In some embodiments, the base sheet section 202 may be substantially the same size as the top sheet section 201.

The top sheet section 201 may be formed of the same material as the base sheet section 202. In some embodiments, the top sheet section 201 may comprise an address window (not shown) to display a recipient's address printed on a letter or other primary material. The address window may be formed of a clear plastic, cellophane, or any other suitable material. In some embodiments, the address window may simply be an opening in the top sheet section 201. In some embodiments, and as illustrated in FIG. 1, the top sheet section 201 may be generally in the shape of a rectangle.

The right-hand sheet section 203 may be comprised of the same material as the base sheet section 201. The right-hand sheet section 203 may be coupled to the base sheet section 202 at a fold line 252. The right-hand sheet section 203 may comprise a tab 211. The tab 211 may comprise an adhesive 210. In some embodiments, the adhesive 210 may comprise, but is not limited to, a glue, where a glue may require moisture to adhere. In some embodiments, the base sheet section 202 may be wider than the right-hand sheet section 203.

The second flap 204 may be coupled to a second side of the top sheet section 201 at a fold line 253. The second flap 204 may comprise an adhesive 207. In some embodiments, the adhesive 207 may comprise, but is not limited to, a self-adhesive that may be a type of gum that does not require moistening in order to adhere. In some embodiments, the adhesive 207 may comprise a backing paper (not shown). In some embodiments, the second flap 204 may be longer and wider than either the third flap 205 or the first flap 209.

The third flap 205 may be coupled to a third side of the top sheet section 201 at a fold line 254. The third flap 205 may comprise an adhesive 206. In some embodiments, the adhesive 206 may be, but is not limited to, a self-adhesive as described previously. The adhesive 206 may comprise a backing paper (not shown) to prevent the third flap 205 from prematurely adhering to a surface.

The first flap 209 may be coupled to a fourth side of the top sheet section 201 and may comprise an adhesive 208. In some embodiments, the adhesive 208 may comprise, but is not limited to, a glue. In some embodiments, the first flap 209 may be the same size as the third flap 205.

Figure 3:
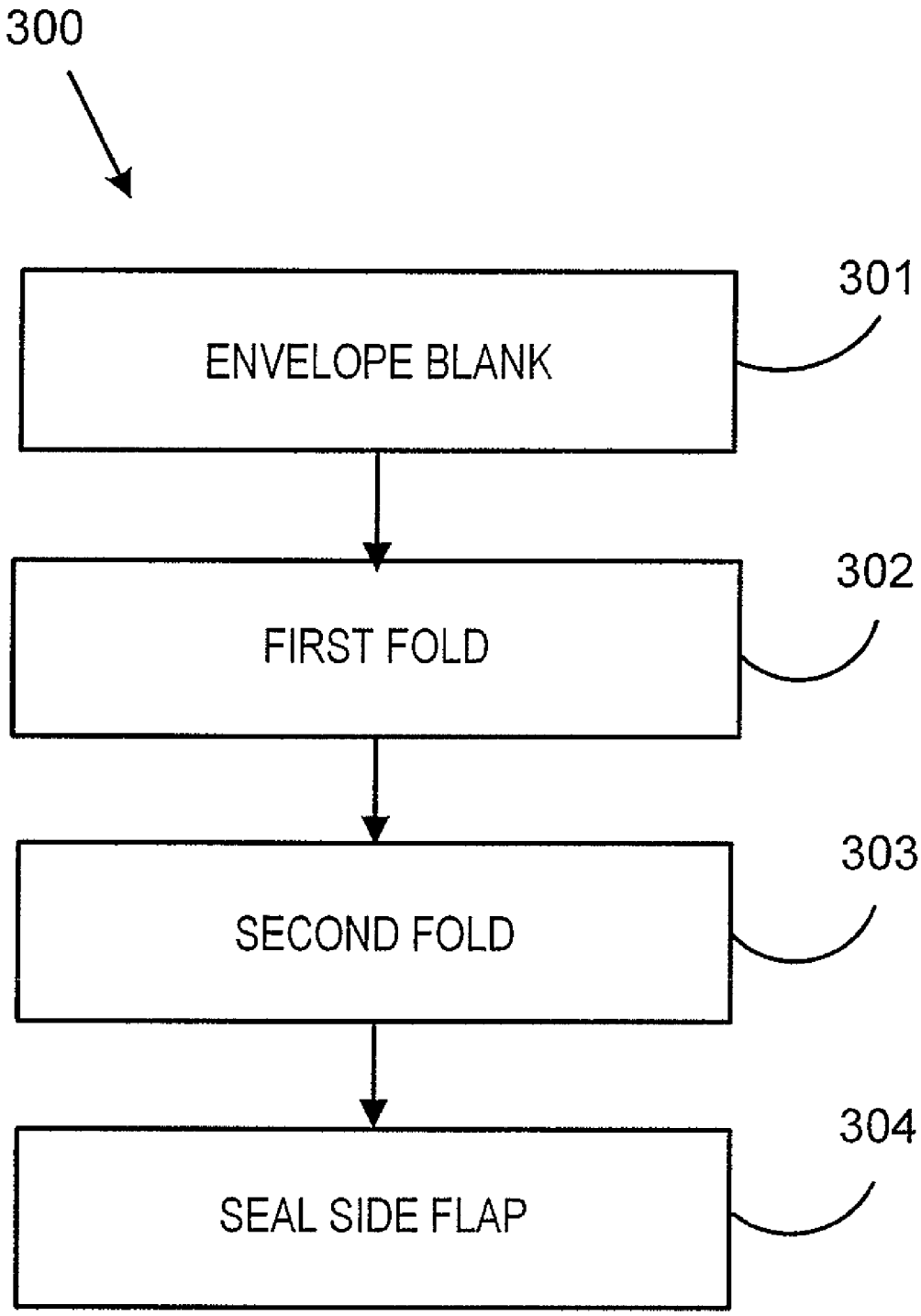
FIG. 3 is a flow chart that illustrates some details of the method of FIG. 1.
Figure 4:
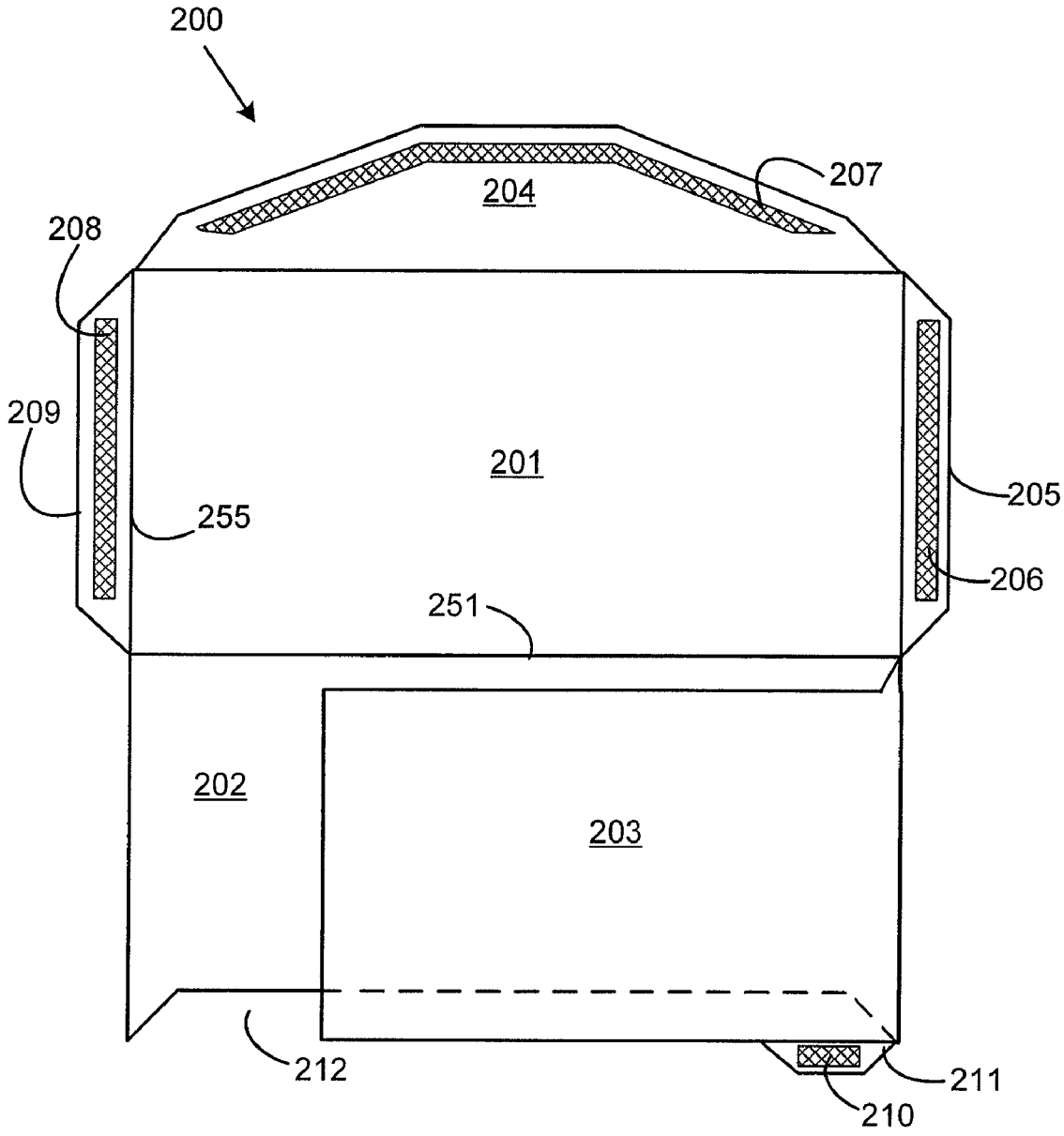
FIG. 4 illustrates the envelope blank in a stage of an assembly of an envelope.
Figure 5:
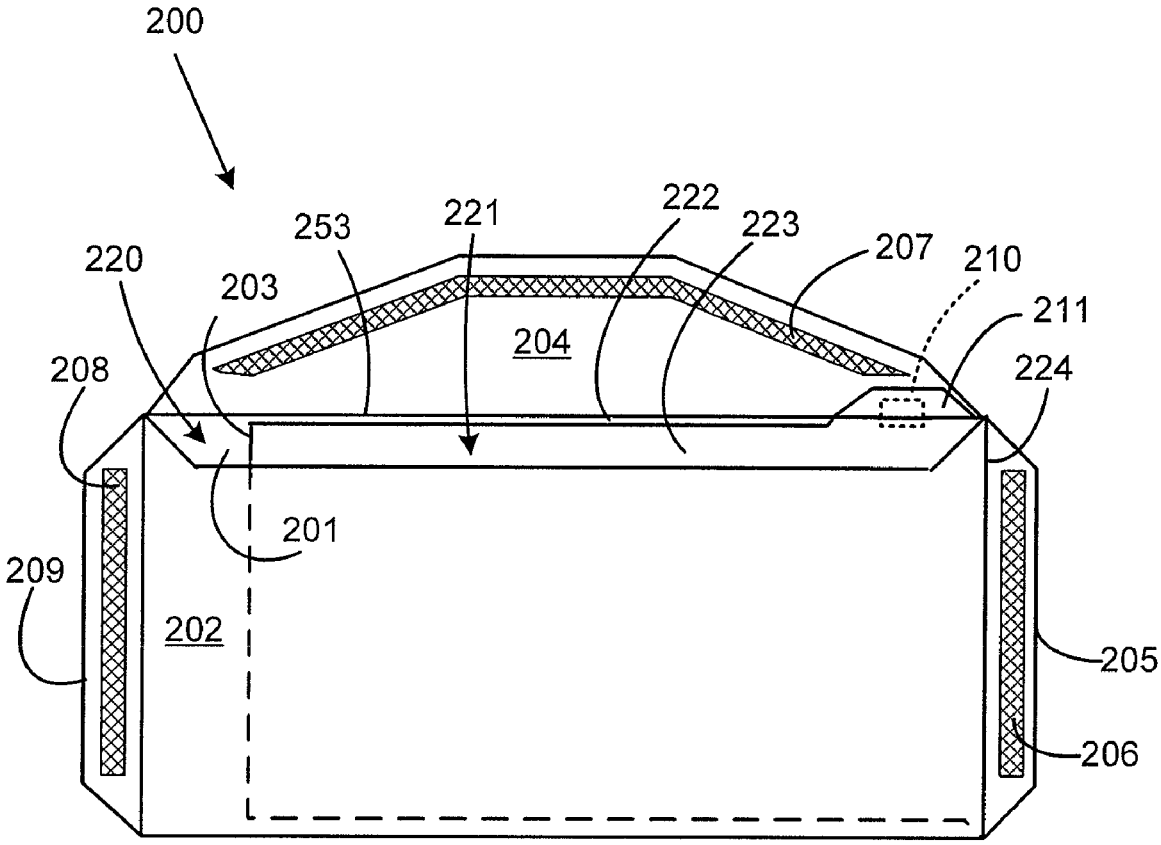
FIG. 5 illustrates an envelope blank in a later stage of the assembly of the envelope.
Figure 6:
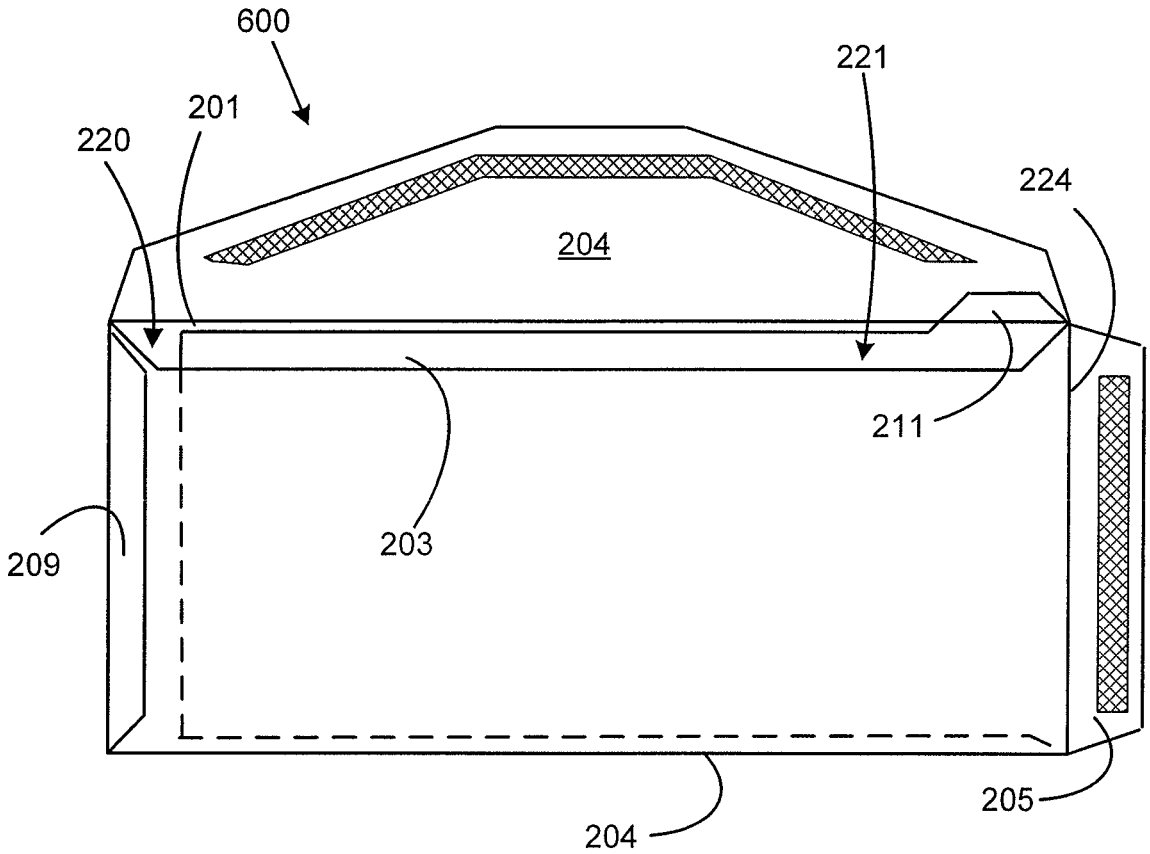
FIG. 6 illustrates the envelope in a condition in which it is ready to have material inserted therein.

Referring again to FIG. 1, at 102, an envelope is formed from the envelope blank. FIG. 3 is a flow chart that illustrates detail of step 102. FIGS. 4, 5 and 6 show stages of assembling an envelope from the envelope blank 200.

At 301 in FIG. 3, the envelope blank is made available for folding. At 302, a fold is performed at the fold line 252 (FIG. 2), such that the right-hand sheet section 203 is folded over the base sheet section 202 to produce the condition shown in FIG. 4. Next, at 303 in FIG. 3, a fold is performed at fold line 251 (FIGS. 2 and 4), such that the left edge of the base sheet section 202 is brought into proximity with the fold line 255 and the right-hand sheet section 203 is positioned between the base sheet section 202 and the top sheet section 201. The condition shown in FIG. 5 results. The tab 211 of the right-hand sheet section 203 may be adhered to the top sheet section 201 using the adhesive 210 to couple the top sheet section 201 to the right-hand sheet section 203 as shown in the illustrated embodiment. The tab 211 may or may not extend above the fold line 253.

The right-hand sheet section 203 may form a pouch for secondary material, hereinafter referred to as advertising material pouch 220, between the right-hand sheet section 203 and the top sheet section 201. The advertising material pouch 220 has a top opening 222 and also a side opening 224. The base sheet section 202 may form a pouch for the primary content, hereinafter referred to as letter pouch 221, between the base sheet section 202 and the right-hand sheet section 203. The letter pouch 221 has a top opening 223, but no side opening due to the fold line 252. The top opening 222 preferably is not as long as the top opening 223, due to the adhesion of the tab 211 to the top sheet section 201.

Referring once more to FIG. 3, at 304, the flap 209 is sealed to complete the envelope 600 (FIG. 6) and render it ready to receive insertions.

Figure 7:
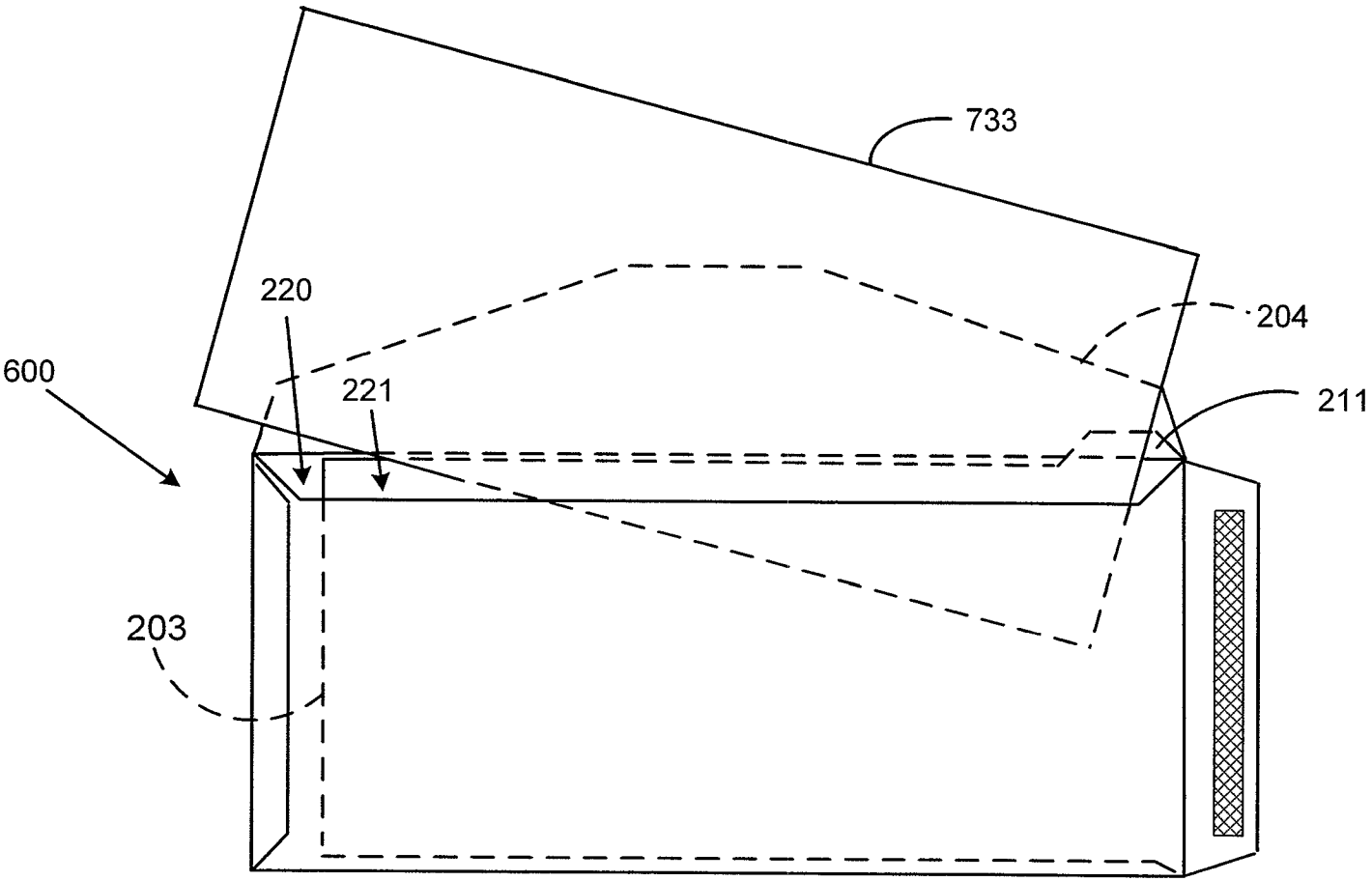
FIG. 7 illustrates a stage in the assembly of a mail piece which is based on the envelope of FIG. 6.

It will be appreciated that steps 101 and 102 of FIG. 1 (the latter step encompassing the process of FIG. 3) may both be performed by an envelope manufacturer. Referring again to FIG. 1, step 103 follows steps 101 and 102. Step 103 may be performed by a mailer that mails personalized letters (e.g., bills or account statements) to mail recipients. The mailer may have purchased the envelope 600 from the manufacturer who performed steps 101 and 102. At step 103, a letter 733 (FIG. 7) is inserted into the letter pouch 221 via the top opening 223 (FIG. 5) of the letter pouch 221. The smaller length of the top opening 222 of the advertising material pouch 220 as compared with the top opening 223 of the letter pouch 221 can aid in preventing the mailer from inadvertently inserting primary content of standard size (e.g., just slightly smaller than the length of the envelope 600) into the advertising material pouch 220, since it would not fit. The letter 733 may be addressed specifically to its intended recipient. The flap 204 (FIG. 6) is open at the time the letter 733 is inserted. The mailer seals the flap 204 after inserting the letter 733. The sealing of the flap 204 closes both the top opening 223 of the letter pouch 221 and the top opening 222 of the advertising material pouch 220. The letter pouch 221 is now effectively sealed so that the letter 733 may be accessed only by opening the envelope (e.g., by tearing the flap 204).

Next, at 104 in FIG. 1, the envelope 600 (now a mail piece that contains the letter 733) is sent to a third party, e.g., advertising mailer, mailing house, etc., to insert any secondary materials. Along with the envelope, the primary mailer may send data indicative of the weight of the mail piece so the third party may be able to determine a quantity of advertising material to place into the envelope without exceeding a specified weight break. The envelope 600 may be sent to the third party in bulk with other similar mail pieces. The mail pieces may already be addressed to their intended recipients, either by having the recipients' addresses printed on the envelope, or by the recipients' addresses on the letters being exposed through a window in each of the envelopes.

Figure 8:
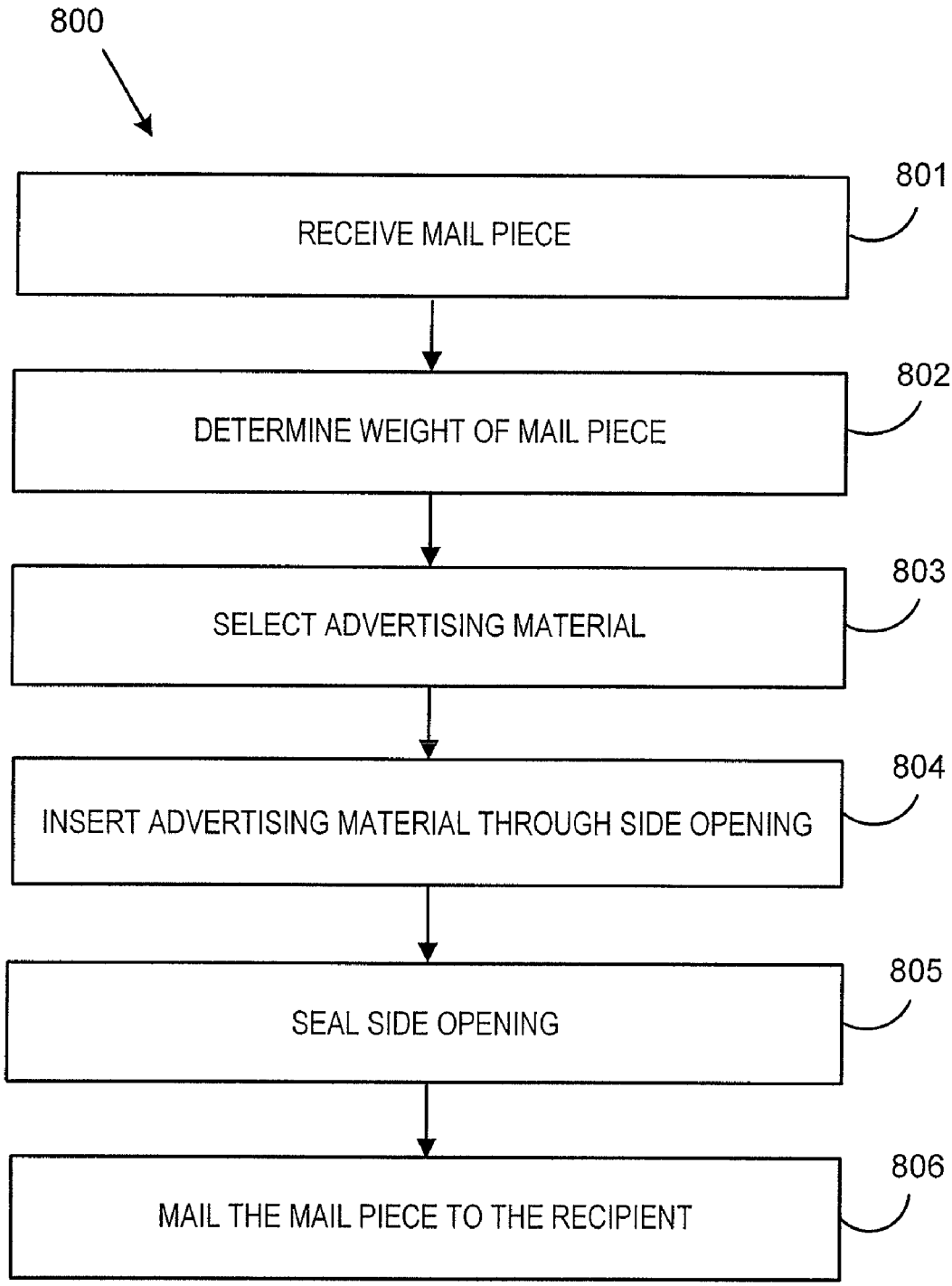
FIG. 8 is a flow chart that illustrates further details of the method of FIG. 1.

At 105 in FIG. 1, the mail piece is processed with other mail pieces by the third party. FIG. 8 is a flow chart that illustrates details of step 105. At 801, the third party receives the mail piece from the primary mailer. At 802, the third party may determine the weight of the mail piece. This may be done based on data provided by the primary mailer, or by weighing the mail piece. At 803, the third party may select the secondary material to be inserted into the envelope. The secondary material may be selected, at least in part, based on the weight of the mail piece prior to having the secondary material inserted therein.

The amount of secondary material inserted may be limited by the desired total maximum weight of the mail piece. For example, if the mail piece is to carry postage for a weight of up to and including 1 ounce, the third party may insert secondary material until the weight of the mail piece equals, but does not exceed, 1 ounce. More generally, secondary material may be selected for insertion into the mail piece so as to bring the weight of the mail piece up to, but not to exceed, the next weight-based break point in the applicable postal rate schedule.

Figure 9:
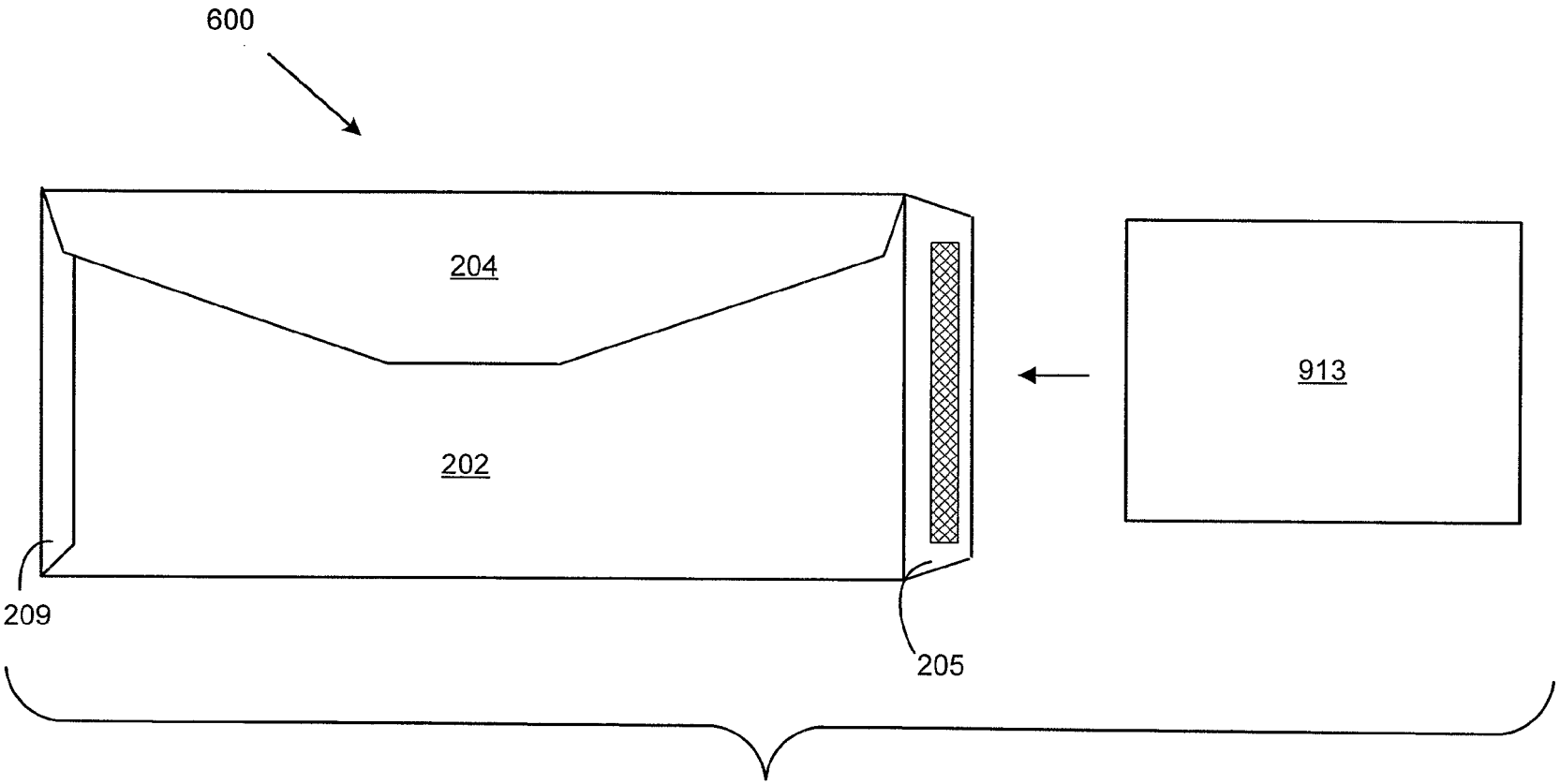
FIG. 9 illustrates a later stage in the assembly of the mail piece.
Figure 10:
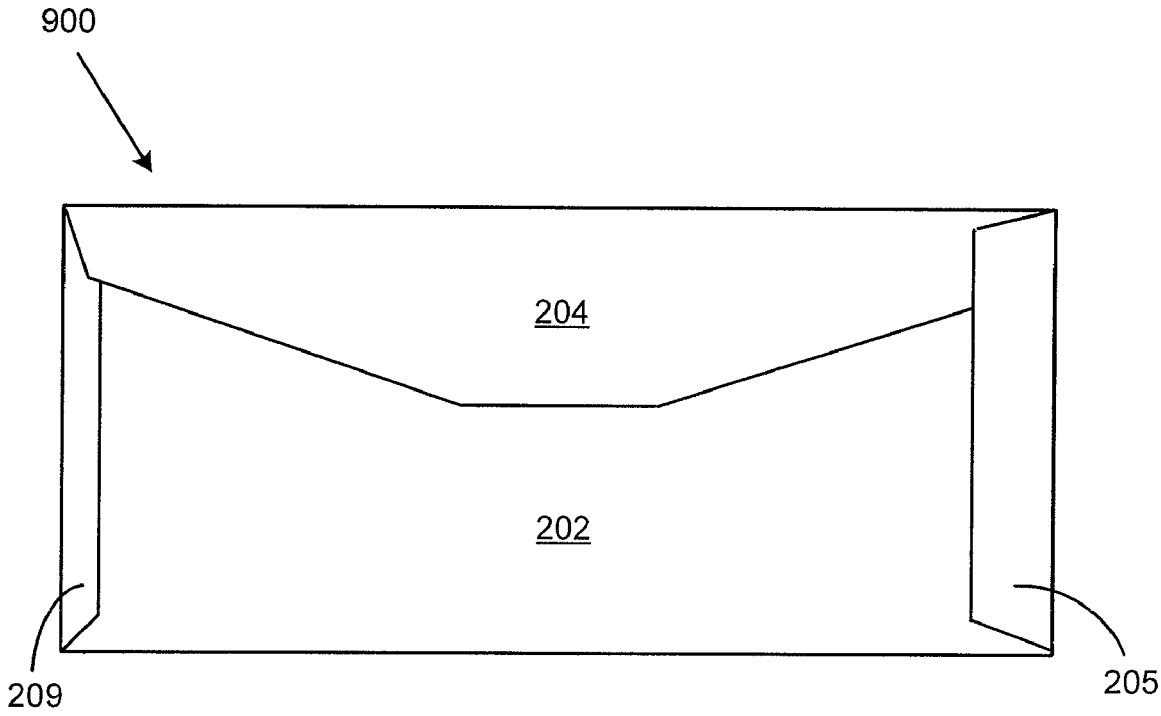
FIG. 10 illustrates the completed mail piece.

At 804, the third party inserts the selected secondary material 913 (FIG. 9) into the advertising material pouch 220 of the envelope 600 via the side opening 224 of the advertising material pouch 220. The flap 205 is open at the time, but is thereafter sealed (step 805 in FIG. 8) to seal the side opening 224, thereby sealing the secondary material 913 inside the advertising material pouch 220. (Although only one sheet of secondary material is explicitly shown in FIG. 9, in practice more than one sheet of advertising material may be inserted, in one or more insertion steps.) The mail piece is now ready to be mailed to the recipient by the third party, as indicated at 806 in FIG. 8. A completed mail piece 900, as mailed to and received by the recipient, is illustrated in FIG. 10.

When the mail recipient receives the mail piece 900 and opens the mail piece by tearing the flap 204, he/she thereby opens both of the letter pouch 221 and the advertising material pouch 220, thereby obtaining access to both the primary content and the secondary material. The recipient has a strong incentive to open the mail piece, since the primary content may be important to the recipient. As a result, the effectiveness of the secondary material may be enhanced. Moreover, the costs of preparing the mail piece and the cost of postage therefor may be shared or allocated between the primary mailer and the third party, so as to provide economic benefits to both.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. An envelope comprising:

a first sheet;

a second sheet forming a first pouch between the second sheet and the first sheet, the first pouch having a first top opening and a side opening;

a third sheet attached to the first and second sheets, the third sheet forming a second pouch between the third sheet and the second sheet, the second pouch having a second top opening;

a first flap for closing the first and second top openings;

the second sheet comprising a tab attached to the first flap and arranged to reduce the length of the first top opening; and a second flap for closing the side opening of the first pouch.

2. The envelope of claim 1, wherein the first, second and third sheets, the tab, and the first and second flaps are all formed from a single sheet of paper.

3. The envelope of claim 1, further comprising:

a third flap to couple the first sheet to the third sheet.

4. The envelope of claim 3, wherein the first flap includes a first adhesive, the second flap includes the first adhesive, the tab includes a second adhesive, and the third flap includes the second adhesive.

5. The envelope of claim 4, wherein the first adhesive is a self-adhesive and the second adhesive is a glue.

6. The envelope of claim 3, wherein the second flap and the third flap are the same size.

7. The envelope of claim 1, wherein the first flap is longer and wider than the second flap.

8. The envelope of claim 1, wherein the tab is adhered to the first sheet to reduce the length of the first top opening.

9. The envelope of claim 1, wherein the first sheet has a first width, the second sheet has a second width and the third sheet has the first width, wherein the second width is less than the first width.

* * * * *